US011242182B2

(12) United States Patent
Ekkert

(10) Patent No.: US 11,242,182 B2
(45) Date of Patent: Feb. 8, 2022

(54) SQUEEZE CAP CONTAINER

(71) Applicant: Phoenix Closures, Inc., Naperville, IL (US)

(72) Inventor: Len Ekkert, Lemont, IL (US)

(73) Assignee: PHOENIX CLOSURES, INC., Naperville, IL (US)

( * ) Notice: Subject to any disclaimer, the term of this patent is extended or adjusted under 35 U.S.C. 154(b) by 2 days.

(21) Appl. No.: 16/718,959

(22) Filed: Dec. 18, 2019

(65) Prior Publication Data

US 2021/0188499 A1 Jun. 24, 2021

(51) Int. Cl.

| | |
|---|---|
| ***B65D 43/10*** | (2006.01) |
| ***B65D 50/04*** | (2006.01) |
| ***B65D 43/02*** | (2006.01) |
| ***B65D 41/16*** | (2006.01) |
| ***B65D 41/04*** | (2006.01) |

(52) U.S. Cl.

CPC ..... *B65D 50/046* (2013.01); *B65D 41/045* (2013.01); *B65D 41/16* (2013.01); *B65D 43/0212* (2013.01); *B65D 2543/00092* (2013.01); *B65D 2543/00537* (2013.01); *B65D 2543/00694* (2013.01)

(58) Field of Classification Search

CPC .. B65D 43/0212; B65D 41/16; B65D 41/045; B65D 41/165; B65D 41/18; B65D 2543/00537; B65D 2543/00814; B65D 2543/00592; B65D 2543/00601; B65D 2543/00611; B65D 2543/0062; B65D 2543/00629; B65D 2543/00638; B65D 2543/00648; B65D 2543/00657; B65D 2543/00666; B65D 2543/00675; B65D 2543/00685; B65D 2543/00694; B65D 2543/00703; B65D 2543/00712; B65D 2543/00722; B65D 2543/00731; B65D 2543/0074; B65D 2543/0075; B65D 2543/00759; B65D 2543/00768; B65D 2543/00777; B65D 2543/00787; B65D 2543/00796; B65D 2543/00805

USPC ..... 215/224

See application file for complete search history.

(56) References Cited

U.S. PATENT DOCUMENTS

| | | | | |
|---|---|---|---|---|
| 4,643,330 | A * | 2/1987 | Kennedy | B65D 41/04 215/329 |
| 5,897,015 | A | 4/1999 | Sheahan | |
| 2018/0186521 | A1* | 7/2018 | Hein | B65D 43/162 |

* cited by examiner

*Primary Examiner* — Allan D Stevens

(74) *Attorney, Agent, or Firm* — Husch Blackwell LLP

(57) ABSTRACT

A container including a base and a cap is provided. The base can include a pull down ramp and first threads on an exterior of the base and the cap can include one or more engagement lugs and second threads on an interior of the cap. The one or more engagement lugs are configured to engage with the pull down ramp to couple the cap to the base and form a hollow section between the cap and the base below the one or more engagement lugs and the pull down ramp and the one or more engagement lugs are configured to disengage from the pull down ramp to decouple the cap from the base when the cap is compressed into the hollow section. The second threads are configured to engage with the first threads to tighten a top of the cap against an upper lip of the base.

4 Claims, 6 Drawing Sheets

SQUEEZE CAP CONTAINER

FIELD

The present invention relates generally to containers. More particularly, the present invention relates to a container having a squeeze cap.

BACKGROUND

Known containers can include a squeeze cap that quickly and easily allows for removal of the cap from a base that includes an opening for storing items. However, such known containers suffer from several problems. First, such known containers are difficult and costly to manufacture. Second, the force that secures the cap to the base of such known containers is not sufficient to allow a liner to be sealed over the opening.

In view of the above, there is a need and an opportunity for improved containers.

DETAILED DESCRIPTION

While this invention is susceptible of an embodiment in many different forms, specific embodiments thereof will be described herein in detail with the understanding that the present disclosure is to be considered as an exemplification of the principles of the invention. It is not intended to limit the invention to the specific illustrated embodiments.

Figure 1:
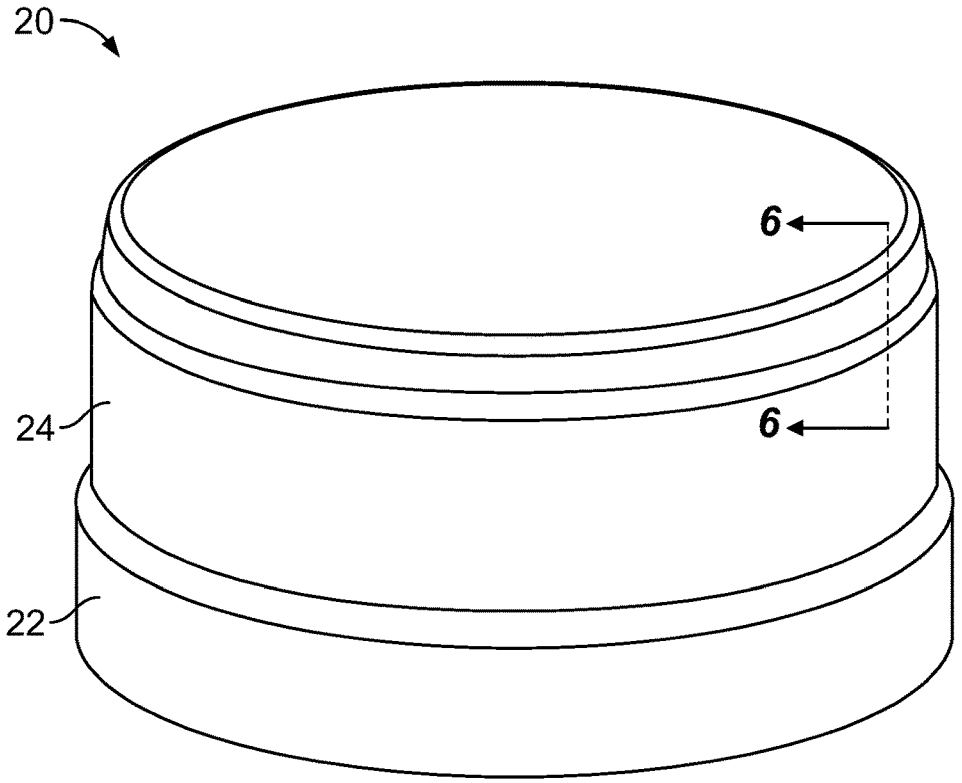
FIG. 1 is a perspective view of a container in accordance with disclosed embodiments.
Figure 2A:
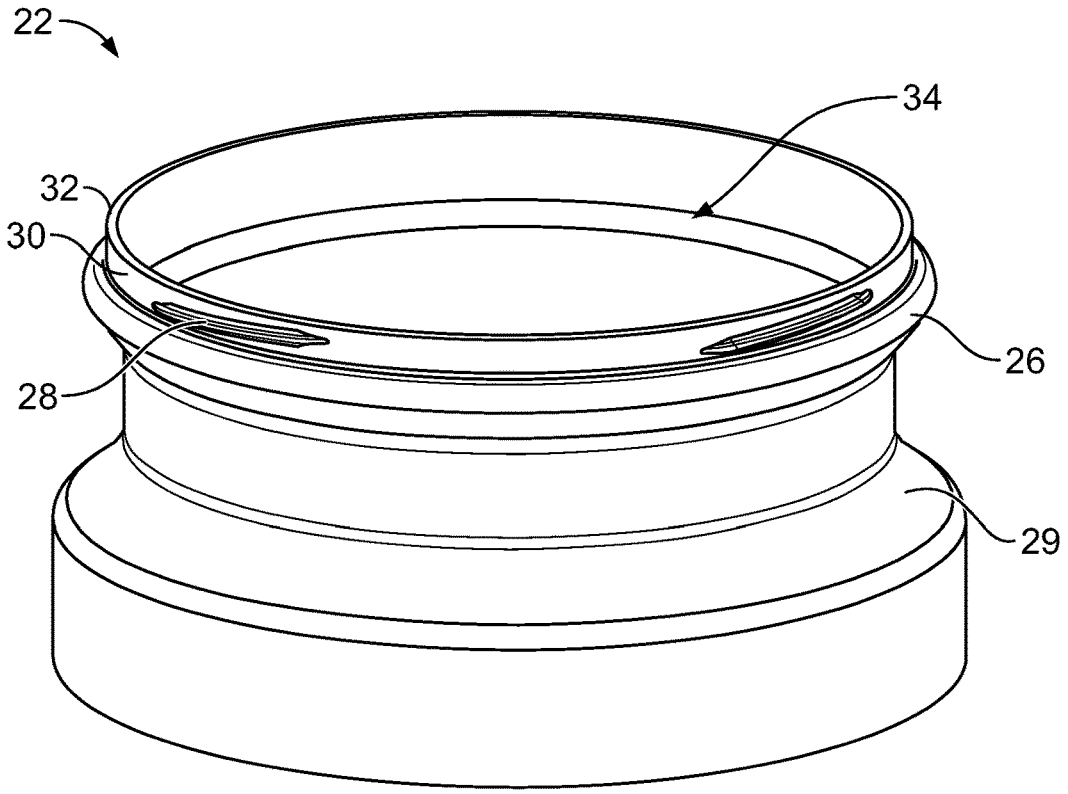
FIG. 2A is a perspective view of a base in accordance with disclosed embodiments.
Figure 2B:
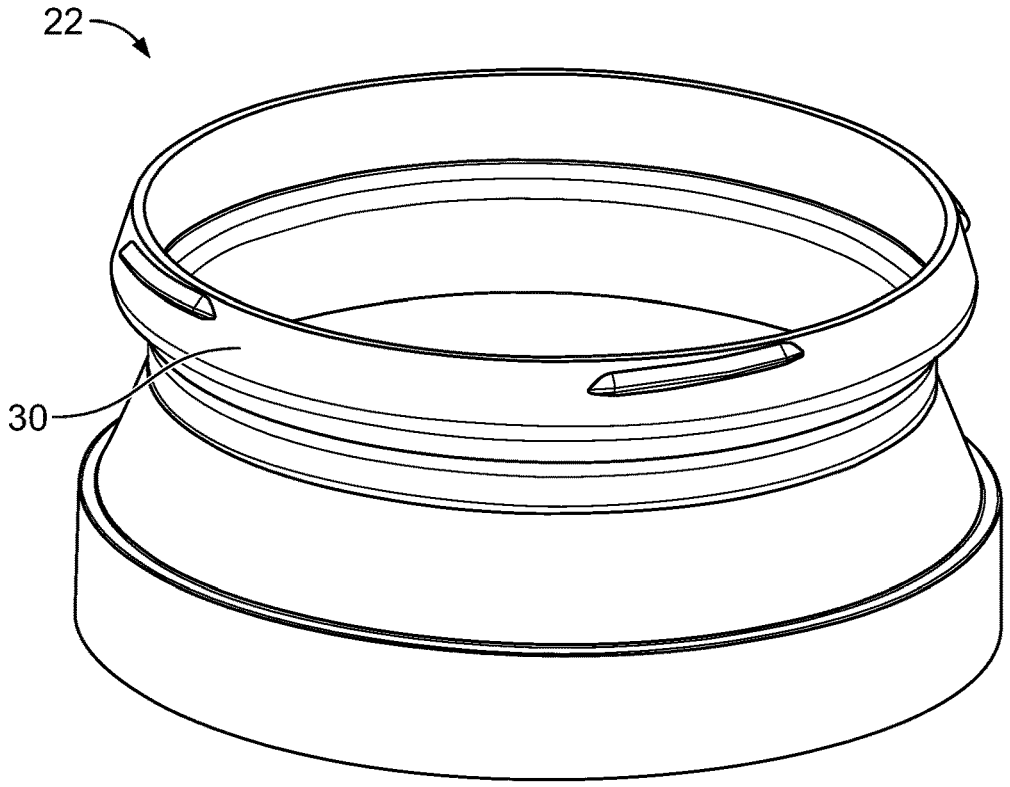
FIG. 2B is a perspective view of a base in accordance with disclosed embodiments.

As seen in FIG. 1, Embodiments disclosed herein can include a container 20 having a base 22 that couples to a cap 24. As seen in FIG. 2A, in some embodiments, the base 22 includes a pull down ramp 26, first threads 28 on an exterior of the base 22, and a continuous ramp 29 on the exterior of the base 22. In some embodiments, the first threads 28 are located above the pull down ramp 26 on a collar 30. In some embodiments, such as shown in FIG. 2A, the collar 30 extends straight upward from the pull down ramp 26 towards an upper lip 32 that defines and opening 34. Additionally or alternatively, in some embodiments such as seen in FIG. 2B, the collar 30 slopes away and inward from the pull down ramp 26 toward the upper lip 32. In such embodiments, the inward slope of the collar 30 can assistant the process of disengaging the cap 24 from the base 22 as discussed below.

Figure 3:
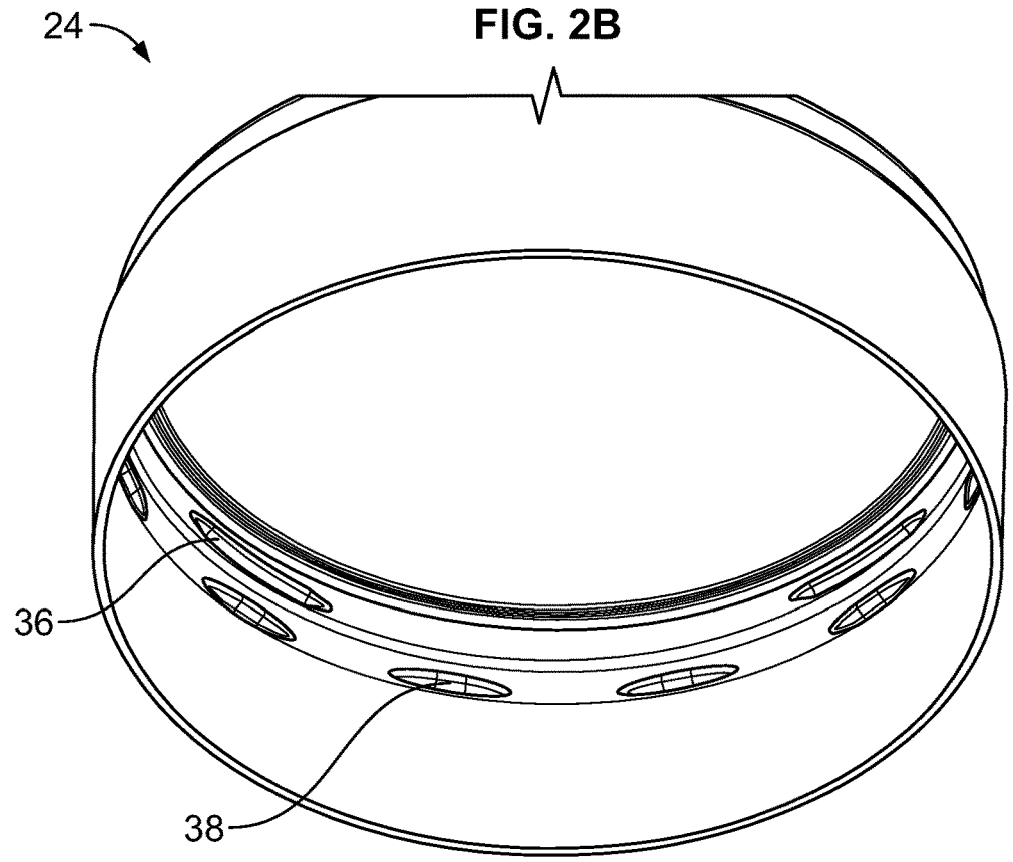
FIG. 3 is a perspective view of a cap in accordance with disclosed embodiments.

FIG. 3 is a perspective view of the cap 24 according to disclosed embodiments. As seen in FIG. 3, the cap 24 includes second threads 36 and one or more engagement lugs 38 on an interior of the cap 24. As further seen in FIG. 3, the second threads 36 are discrete and spaced apart from the one or more engagement lugs 38.

Figure 4:
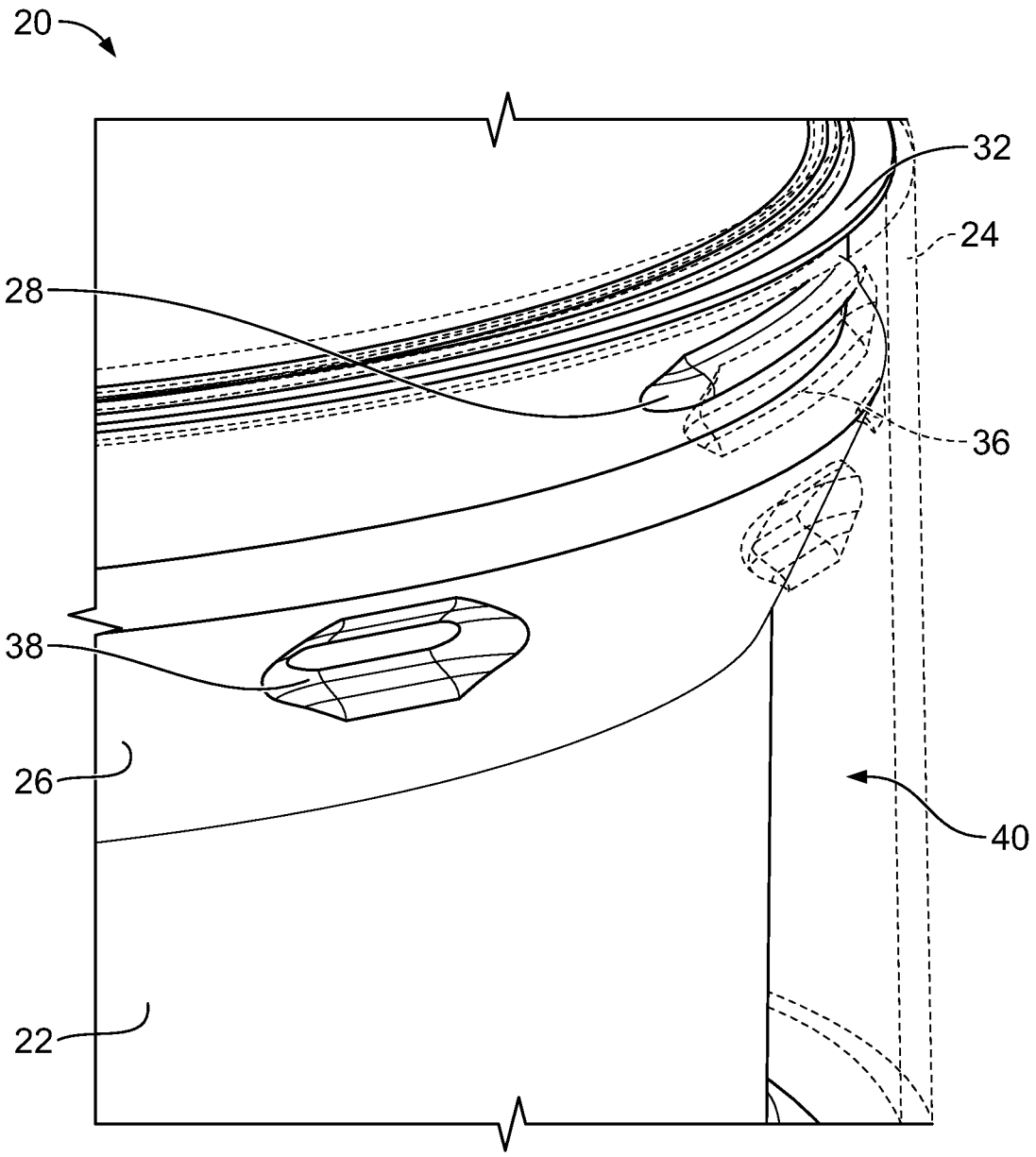
FIG. 4 is a partial perspective view of the base of FIG. 2A coupled to the cap of FIG. 3.

FIG. 4 is a partial perspective view of the base 22 and a partially transparent view of the cap 24. As seen in FIG. 4, the one or more engagement lugs 38 are configured to engage with the pull down ramp 26 to couple the cap 24 to the base 22. Furthermore, as seen in FIG. 4, when the cap 24 is coupled to the base 22, the cap 24 forms a hollow section 40 between the cap 24 and the base 22 below the one or more engagement lugs 38 and the pull down ramp 26. In some embodiments, the cap 24 is configured to engage with the continuous ramp 29 (see FIG. 2A) to trigger disengagement of the one or more engagement lugs 38 from the pull down ramp 26 so as to decouple the cap 24 from the base 22 when the cap 24 is compressed into the hollow section 40. Further still, as seen in FIG. 4 the second threads 36 are configured to engage with the first threads 28 to tighten a top of the cap 24 against the upper lip 32 of the base 22. In some embodiments, the second threads 36 are aligned with at least some of the one or more engagement lugs 38 to assist in disengaging the one or more engagement lugs 38 from the pull down ramp 26 when the cap 24 is compressed into the hollow section 40. In some embodiments, the engagement of the first threads 28 with the second threads 36 is configured to block decoupling of the cap 24 from the base 22 by increasing the engagement. In some embodiments, a pitch of the first threads and the second threads can be a 2-TPI (threads per inch), or up to a 10-TPI.

Figure 5:
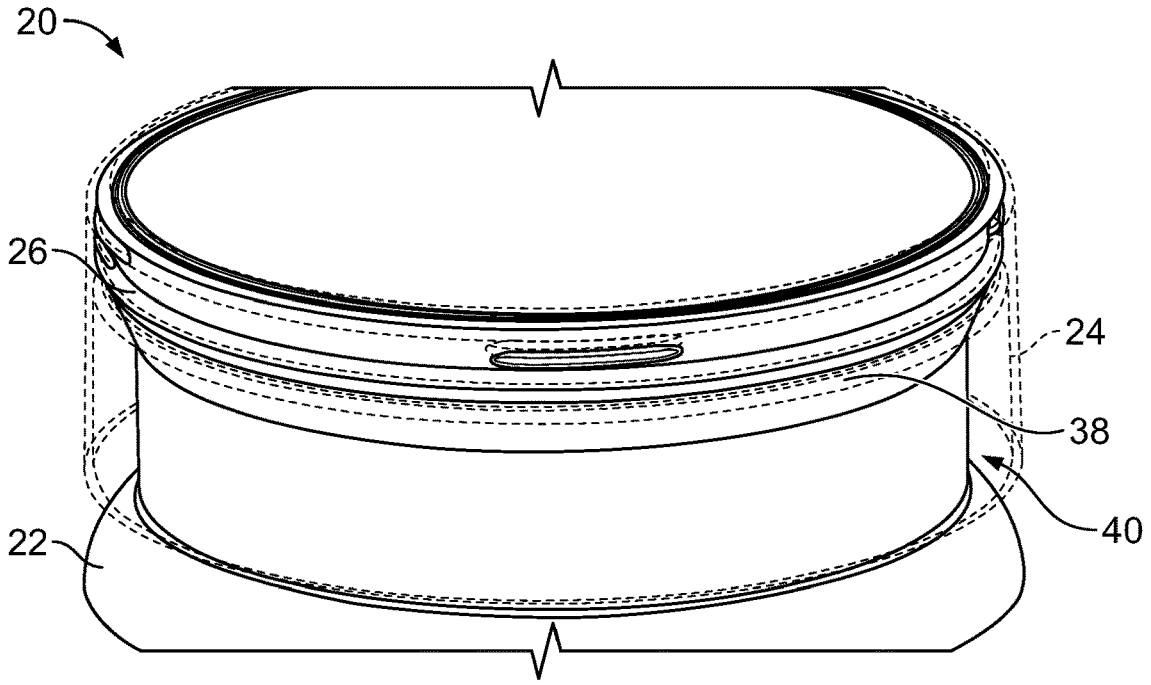
FIG. 5 is a perspective view of a container in accordance with disclosed embodiments.

In some embodiments, such as shown in FIG. 4, the one or more engagement lugs 38 include a plurality of engagement lugs spaced around the inside of the cap 24. Employing a plurality of spaced apart engagement lugs allows for easier flexing of the cap 24 to trigger the disengagement of the cap 24 from the base 22. However, other embodiments are also contemplated. For example, as seen in FIG. 5, in some embodiments, the one or more engagement lugs 38 include a single continuous lug that runs around a circumference of the inside 25 of the cap 24.

Figure 6:
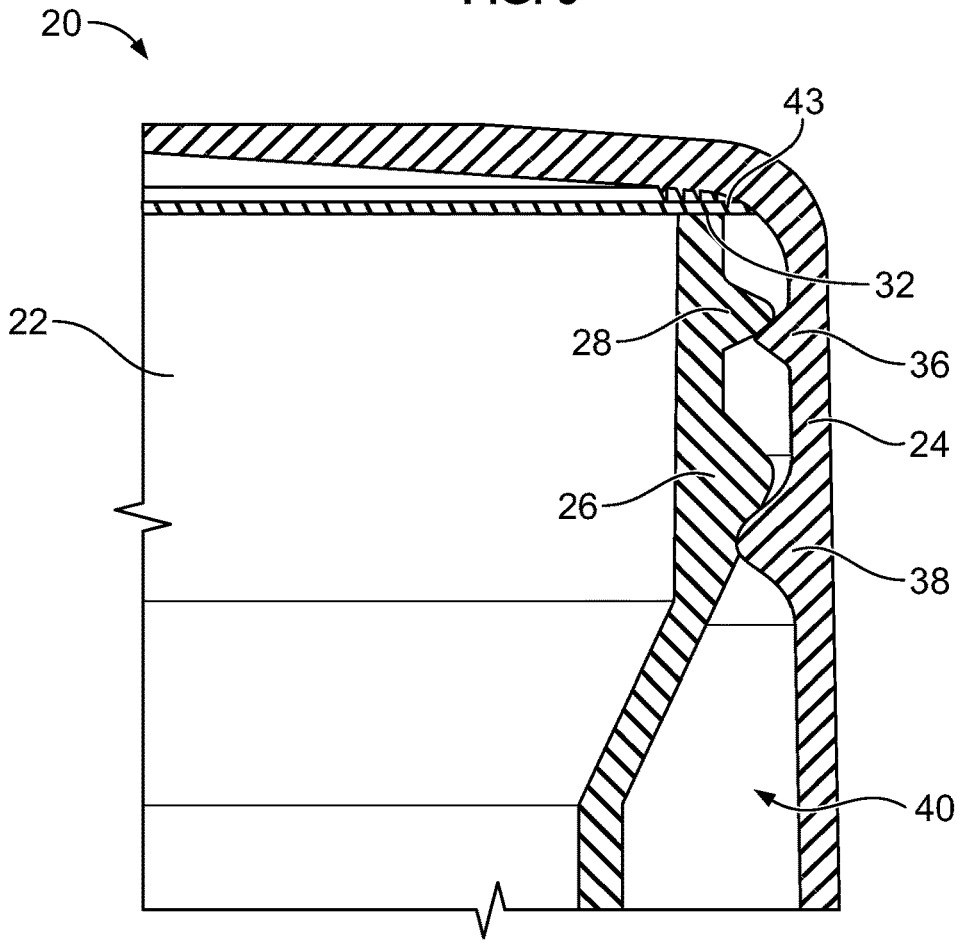
FIG. 6 is a partial cross-section view of a container in accordance with disclosed embodiments taken along the lines 6-6 of FIG. 1.

FIG. 6 is a partial cross-section view of the container 24 in accordance with disclosed embodiments. As see in in FIG. 6, in some embodiments, the container 20 includes a liner 43 disposed between the top of the cap 24 and the upper lip 32 of the base 22 and covering the opening 34 (See FIG. 2A). As further seen in FIG. 6, the engagement of the first threads 28 with the second threads 36 is configured to secure the liner 43 to the upper lip 32 with sufficient force to enable induction sealing of the liner 43 to the upper lip 32. As seen in FIG. 6, the one or more engagement lugs 38 have a profile that partially overlaps the pull down ramp 26. This partial overlap helps to generate a pull down force that secures the cap 24 to the base 22. In some embodiments, the pull down ramp has a length sufficient to enable the pull down ramp 26 to pull the cap 24 down onto the base 22 if the liner 43 is removed.

Figure 7A:
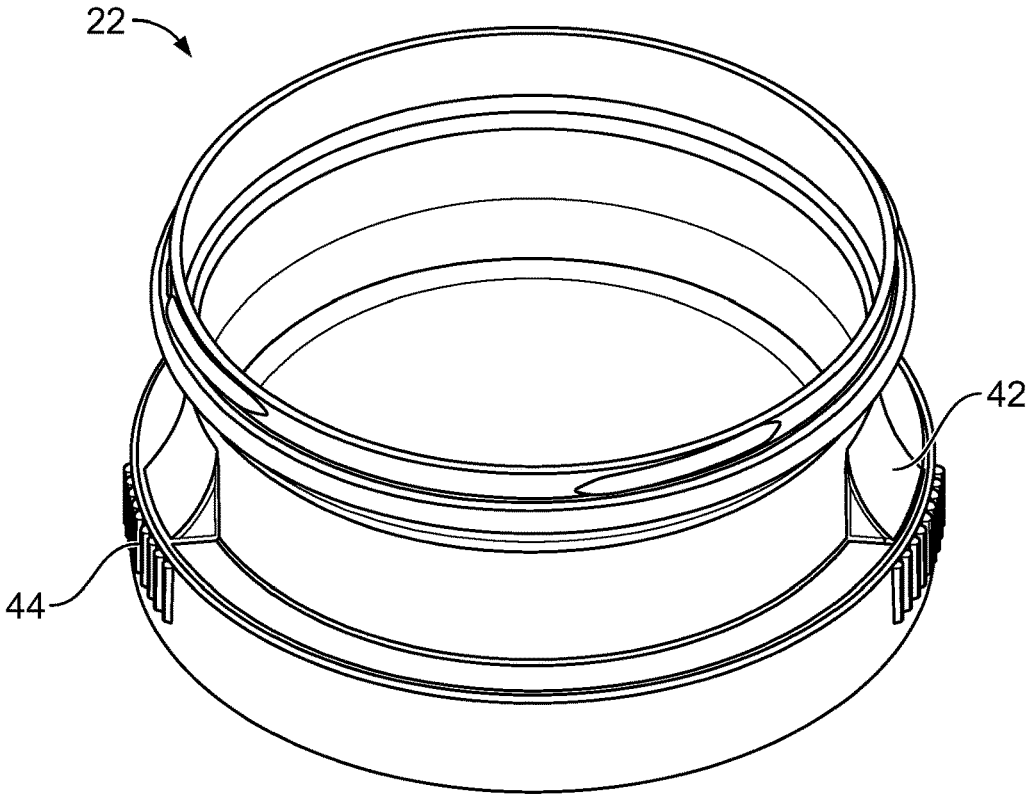
FIG. 7A is a perspective view of a base in accordance with disclosed embodiments.
Figure 7B:
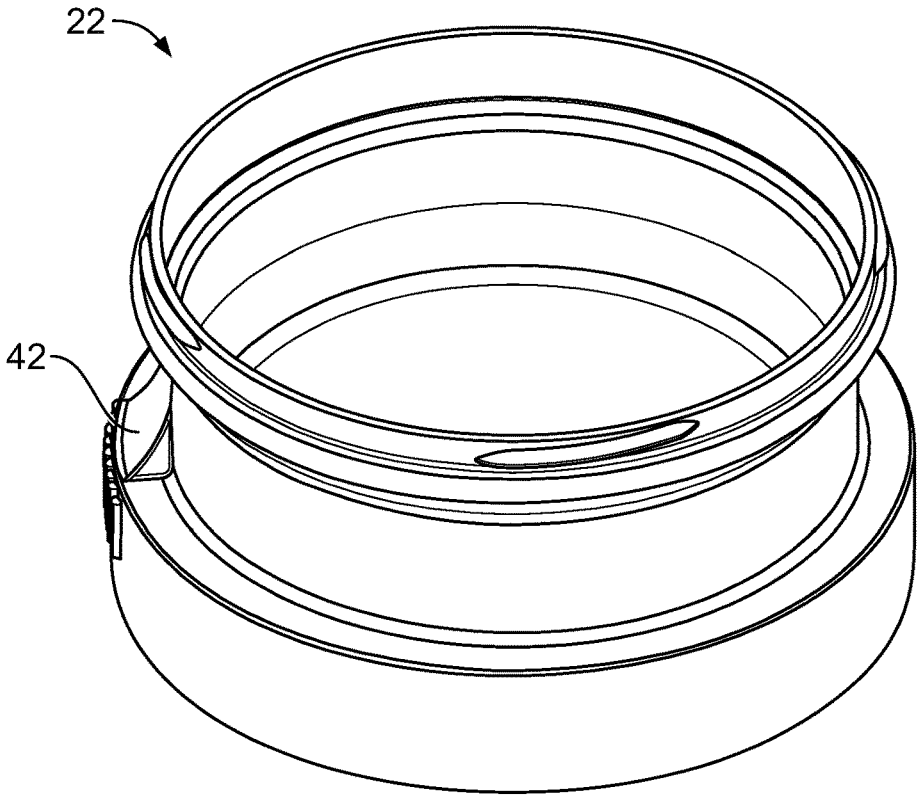
FIG. 7B is a perspective view of a base in accordance with disclosed embodiments.
Figure 8:
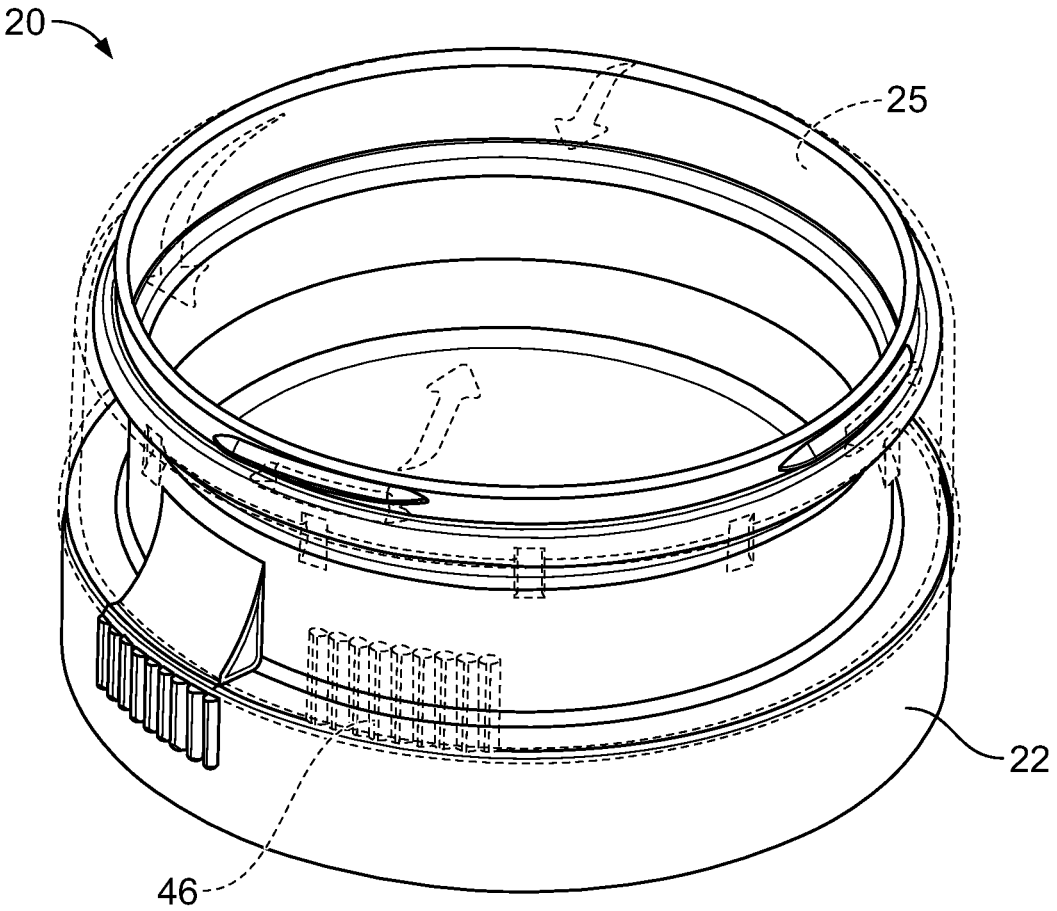
FIG. 8 is a perspective view of a container in accordance with disclosed embodiments.

FIG. 7A is a perspective view of the base 22 in accordance with disclosed embodiments. As seen in FIG. 7A, in some embodiments, the continuous ramp 29 of the base 24 is replaced by discrete ramps 42 that have locations marked by sidewall ribs 44. As seen in FIG. 7B, in some embodiments, the base 22 can include only one discrete ramp 42. Additional embodiments having more than 2 discrete ramps 42 in various positions are also contemplated. Employing the discrete ramps 42 in place of the continuous ramp 29 of FIG. 2A produces a "Child Resistant" container package. In particular, as seen in FIG. 8, the cap 24 includes side wall ribs 46 that have to be aligned with the discrete ramps 42 to trigger disengagement of the cap 24 from the base 22. Therefore, the discrete ramps 42 represent the only location where the squeezing of the cap 24 will allow the cap 24 to ramp upwards.

The cap 24 and the base 22 can be manufactured from a variety of methods. For example, in some embodiments, the cap 24 and the base 22 can be injection molded. In such embodiments, the injection mold for the base 22 can include slides for creating the first threads 28 and the recessed middle section that forms the hollow section 40 when the cap 24 is coupled to the base 22. In some embodiments, a bottom of the base 22 can be hollowed out to reduce mold repair issues with manufacturing the base 22.

The embodiments disclosed herein are also directed towards a method for sealing the container 20 of FIGS. 1-8. For example, the method can include positioning the liner 43 on the upper lip 32 of the base 22 such that the liner 32 covers the opening 40. Then, the method can include coupling the cap 24 to the base 22 by engaging the one or more engagement lugs 38 with the pull down ramp 26. Next, the method can include increasing a force that secures the liner 43 between the upper lip 32 and a top of the cap 24. In some embodiments, the force can be increased by engaging the first threads 28 with the second threads 36. Finally, the method can include sealing the liner 43 to the upper lip 32, for example by induction sealing.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A container comprising:

a base including a pull down ramp, a second ramp, and first threads on an exterior of the base, the first threads attached to a collar of the base;

a cap having one or more engagement lugs and second threads on an interior of the cap; and a liner disposed between the top of the cap and an upper lip of the base, wherein the liner covers an opening in the base defined by the upper lip, the collar extending straight upward from the pull down ramp towards the upper lip;

wherein the second threads are discrete and spaced apart from the one or more engagement lugs, wherein the one or more engagement lugs are engaged with the pull down ramp to couple the cap to the base and form a hollow section between the cap and the base below the one or more engagement lugs and the pull down ramp, wherein the cap is configured to engage with the second ramp when compressed into the hollow section to trigger disengagement of the one or more engagement lugs from the pull down ramp to decouple the cap from the base, and wherein the second threads are configured to engage with the first threads to tighten the top of the cap against the upper lip of the base.

2. The container of claim 1 wherein the engagement of the first threads with the second threads is configured to secure the liner to the upper lip with sufficient force to enable induction sealing of the liner to the upper lip.

3. The container of claim 1 wherein the first threads are positioned above the pull down ramp.

4. The container of claim 1 wherein the one or more engagement lugs include a plurality of engagement lugs spaced around an inside of the cap.

* * * * *